US005297410A

United States Patent [19]

Goff

[11] Patent Number: 5,297,410

[45] Date of Patent: Mar. 29, 1994

[54] METHOD OF MANUFACTURING A MULTIPLE-WALLED TUBE

[75] Inventor: Robert W. J. Goff, Abingdon, England

[73] Assignee: Bundy International Limited, Abingdon, England

[21] Appl. No.: 985,935

[22] Filed: Dec. 4, 1992

[30] Foreign Application Priority Data

Dec. 10, 1991 [BE] Belgium ..... 09101122

[51] Int. Cl.[5] ..... B21C 37/06

[52] U.S. Cl. ..... 72/47; 72/368; 138/143

[58] Field of Search ..... 72/47, 367, 368; 138/143, 142, 144, 140; 28/890.036, 890.053, 890.054

[56] References Cited

U.S. PATENT DOCUMENTS

| | | | |
|---|---|---|---|
| 3,073,019 | 1/1963 | Caplan et al. | 72/47 |
| 3,511,283 | 5/1970 | Iannone | 138/143 |
| 3,696,499 | 10/1972 | Dromsky . | |
| 3,798,011 | 3/1974 | Sharp | 138/143 |
| 3,875,027 | 4/1975 | Gondek . | |
| 4,505,232 | 3/1985 | Usami et al. | 138/143 |
| 4,685,427 | 8/1987 | Tassen et al. | 138/143 |
| 4,885,215 | 12/1989 | Yoshioka et al. | 138/143 |

FOREIGN PATENT DOCUMENTS

| | | | |
|---|---|---|---|
| 701194 | 3/1931 | France . | |
| 988958 | 9/1951 | France . | |
| 1015678 | 10/1952 | France . | |
| 0053715 | 3/1989 | Japan | 29/890.053 |
| 1406043 | 9/1975 | United Kingdom . | |
| 1591907 | 7/1981 | United Kingdom . | |
| 2241185 | 8/1991 | United Kingdom . | |

OTHER PUBLICATIONS

Patents Abstracts of Japan, vol. 5, No. 33 (M-57) (705), Feb. 28, 1991.

*Primary Examiner*—Lowell A. Larson
*Assistant Examiner*—Michael J. McKeon
*Attorney, Agent, or Firm*—Jacobson, Price, Holman & Stern

[57] ABSTRACT

The invention relates to a method of manufacturing a tube, comprising the application respectively to one side of a metal strip 1 a first layer 2 of a first metal which is brazeable and to the other side of the metal strip 1 a second layer 3 of a second metal which is different from the first metal, and, after application of said layers 2,3, rolling of the strip 1 in order to form a tube having at least two walls.

8 Claims, 1 Drawing Sheet

METHOD OF MANUFACTURING A MULTIPLE-WALLED TUBE

FIELD OF THE INVENTION

The invention relates to a method of manufacturing a multiple-walled tube, comprising the application respectively to one or the other side of a metal strip respectively of a first or of a second layer of a brazeable metal and, after application of said layers, to the rolling of the strip in order to form a tube having at least two walls.

BACKGROUND OF THE INVENTION

A method of this type is known from Patent Application No. GB PA 2.241.185. According to the known method, there are applied, as a first and second layer, a layer of copper on a metal strip. The strip is then rolled to form a multiple-walled tube. According to the known method, the strip is rolled through two complete revolutions, thus forming a double-walled tube. The fact that the tube has double walls implies that, between the two walls of the tube, there is also a layer of copper. After rolling of the strip, the tube thus formed is heated in order to subject to brazing the surfaces of the walls which are in contact with one another.

The application of a layer of copper or of another brazeable metal to one or both sides of a metal strip has the advantage of improving the technical qualities of the tube, particularly as regards corrosion resistance by application of a layer of nickel, its suitability for brazing or its protection from the liquids circulating in the tube.

Whereas the application of a layer of metal to the strip does in fact offer advantages, it has however been noted that it could likewise give rise to problems. For example, in the case of tubes used as brake-fluid lines in a vehicle, the copper layer inside the tube offers good resistance to brake fluid, an aggressive substance, but the external copper layer does not offer sufficient corrosion protection for the tube, which is sited in places extremely exposed to bad weather. The tube must then be protected by an additional covering, for example of zinc. However, the copper layer, already applied to the metal strip, is not ideal as regards electrochemical couple and limits the quality of the whole product as regards corrosion.

Another problem noted is the dissolution of copper applied to the internal surface of the tube. Certain alcohols used as fuel additives, particularly in lead-free petrol, attack and dissolve the copper, which finally blocks the injectors of combustion engines.

SUMMARY OF THE INVENTION

The purpose of the invention is to remedy these drawbacks.

To this end, a method according to the invention is characterised in that there are applied as said first and second layers, a first metal and a second metal respectively, the said second metal being different from the said first metal. The choice of two layers of different metal permits application of the most suitable metals for the finished tube, and also protection of the tube internally and externally. As both the first and the second metal may be brazed, brazing itself will not be interfered with by the application of two different layers. By opting for a second layer of a metal different from that used for the first layer, it is possible to use the same strip for two different tubes, simply by choosing the direction of rotation of the strip. This greater diversity also enables use of tubes more appropriate to their final purpose, without the necessity of using other strips.

The application of two different layers thus provides a solution to problems of external corrosion as well as attack on the tube from the interior by liquids passing through it, without however impairing the brazing qualities of the tube.

A first preferred embodiment of the method according to the invention is characterised in that copper or respectively nickel is applied as a first or respectively second metal. Nickel is an excellent anti-corrosive, and resists well the alcohols or other fuel additives, while copper is entirely suitable for brazing. Thus advantageous properties as regards brazing and corrosion resistance are unified.

According to another preferred embodiment of the method according to the invention, nickel or respectively tin is applied as a first or respectively second metal, or tin or respectively copper is applied as a first or respectively second metal. Tin offers good protection against oxidation.

A second preferred embodiment of the method according to the invention is characterised in that, after rolling of the strip, a third layer is applied, formed by an alloy, to the external surface of the tube. Protection of the tube is thus increased.

A third preferred embodiment of the method according to the invention is characterised in that the said layers are applied by using a high current density. This high current density enables rapid deposition of the layer to be applied, and thus substantially reduces the probability of interference with the metals used for the different layers.

BRIEF DESCRIPTION OF THE DRAWINGS

The invention will now be described in more detail with the aid of an embodiment given by way of example and illustrated in the drawings, which show.

DETAILED DESCRIPTION OF THE DRAWINGS

Figure 1:
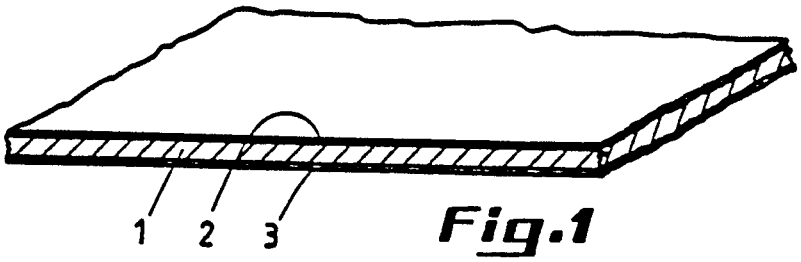
FIG. 1 a sectional view of a metal strip to which two layers of metal have been applied.

In the drawings, the same reference numerals have been assigned to the same components, or to similar components.

In order to manufacture a multiple-walled tube, a metal strip is used, such, for example, as a steel strip with a thickness of 0.355 mm. FIG. 1 shows a sectional view of a metal strip 1 to which two layers of metal have been applied. In the method according to the invention, firstly there is applied a first layer 2 of a first brazeable metal, to a first side of the strip. Then there is applied to the other side of the strip a second layer 3 of a second brazeable metal, the second metal being different from the first.

As a first metal there is applied for example a layer of $3\mu$ of copper, while a layer of $3\mu$ of nickel is used as the second metal. This combination has the advantage that nickel is an excellent anti-corrosive, while copper is well suited to brazing. As copper and nickel have melting temperatures of 1080° and 1452° C. respectively, fusion between these two metals is effected at a temperature of between 1200° and 1300° C., and it is thus possible to braze the tube formed after rolling of the strip provided with the two layers.

In addition, it has been noted that copper and nickel are a good choice, because at approximately 550° C., diffusion of one metal into the other takes place.

Figure 2:
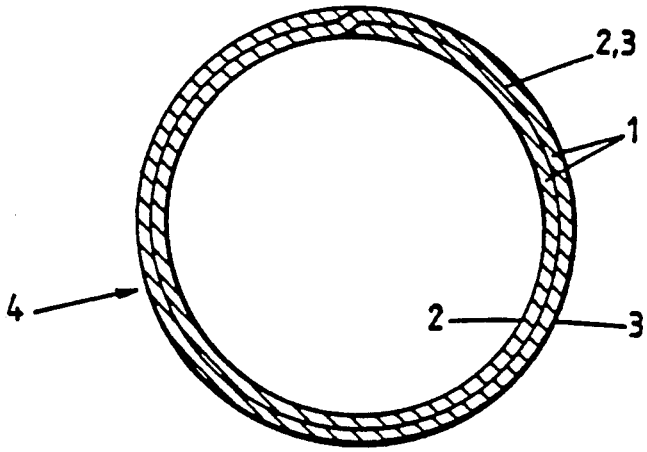
FIG. 2 a sectional view of a tube obtained by application of the method according to the invention.

In effect, in order to obtain a multiple-walled tube, such, for example, as a double-walled tube, a cross-section of which is shown in FIG. 2, the strip is rolled two or more times, so that two or more walls are formed. During rolling, care is obviously taken to ensure that the successive walls touch one another. Once the strip is rolled, the brazing operation can commence.

Rolling of the strip in the method according to the invention, in which there is used a strip with two different layers, will have the result that between two successive layers, the layer of first metal will enter into contact with the layer of the second metal. It is consequently of prime importance to choose two metals which can be brazed, and in which the difference in brazing temperature is not too great. Too large a temperature differential could in fact bring about problems during brazing. For example, combinations must be avoided with a first or respectively a second metal having a melting temperature of the order of 200° C. or of the order of 1000° C. It has however been noted that the higher the melting temperatures, the greater will be the difference in acceptable temperature.

The tube 4 obtained by application of the method according to the invention thus has an internal layer 2 of a metal different from that of the external layer. In addition, both the interior and the exterior of the tube are provided with a protective layer, which would not be the case if the layer were applied to only one side.

A tube whose internal layer is different from the external layer has the advantage that the finished tube can be taken into greater account. To take the example of a vehicle in which there are found petrol lines as well as oil- or brake-fluid lines. The fuel, in particular lead-free petrol, includes several additives in order to increase the octane rating. Alcohols, which may attack copper, are used as additives. Particles of copper can then block the injectors. For petrol lines it is necessary to use, for example, a tube provided with an internal layer of nickel, which perfectly resists alcohol or other additives. The external layer must then for example be formed by a copper layer, which offers sufficient protection against corrosion, in view of the fact that fuel lines need not necessarily be located at points which are extremely exposed. Corrosion resistance may moreover be improved by a layer of zinc or of a zinc-aluminium alloy applied after formation of the tube.

The problem of brake fluid, an aggressive substance, is entirely different. The best internal layer against brake fluid will be copper. However, brake lines are located at points extremely exposed to bad weather, which requires good external protection against corrosion. Nickel fulfils these demands perfectly. Nickel is in fact an excellent substrate as regards adherence and corrosion resistance for a later deposit such for example as a zinc-nickel alloy, or zinc, or a zinc-aluminium alloy.

The strip comprising two different layers thus enables formation of two types of different tubes from the basis of the same strip. It is sufficient in fact to roll the strip in one direction or the other. Apart from the choice of nickel-copper for the first and the second layer to be applied to the strip, other choices are likewise possible, such as nickel-tin and tin-copper.

After rolling the strip, it is likewise possible to apply to the external wall of the tube a third layer of metal. It is clear that this third layer must then be of a metal different from that applied to the layer of the opposite side. There is preferably used as a third layer an alloy such for example a cupronickel, zinc-nickel for application to a layer of nickel, or cupro-nickel for application to a layer of copper. The advantage of applying a third layer is that corrosion resistance is increased thereby. It is self-evident that other layers may further be applied to this third layer. As a third layer there may likewise be applied a layer of aluminium or of a zinc-aluminium, lead-tin or zinc-nickel alloy.

The third layer is preferably applied to the nickel layer, as nickel forms an excellent base for the application of other layers. The thickness of the third layer is generally substantially greater than that of the first and second layer. Thus, the third layer has a thickness for example of 12 μm or 25 μm, even of 100 μm as a function of the degree of protection required, and of the technology used in its application. The third layer is applied, after rolling of the strip, to the external wall of the tube to be protected. As regards the thickness of this third layer, application of this third layer before rolling would lead to considerable problems during brazing after rolling. The third layer could thus begin to melt, bringing with it the first and the second layer.

The first or the second layer forms an excellent base for adhesion of the third layer. Thus it has been noted that when a third layer of zinc was applied to a layer of nickel, it was sufficient to apply a layer of 7 to 8 μm of zinc to the nickel layer in order to obtain a very high degree of protection. The degree of protection thus obtained is comparable with that obtained by application of a single layer of zinc of 15 μm on a copper base. A considerable reduction in materials used, and a substantial improvement in the productivity of production units are thus obtained without impairing the anticorrosive properties of the tube.

Figure 3:
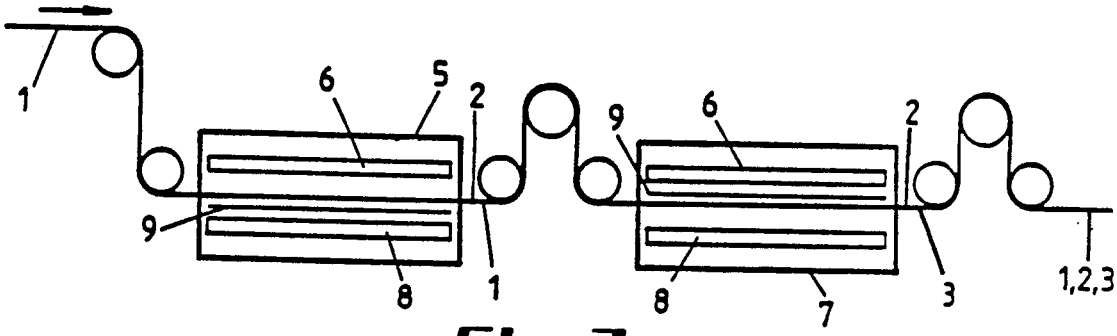
FIG. 3 an example of a device enabling application of two layers of metal to a strip.

FIG. 3 illustrates an embodiment by way of example of a device enabling application to a metal strip of two layers of different metal. FIG. 3 only shows a diagrammatic view, illustrating only those components necessary for understanding of the function of the device. The metal strip 1 is introduced into a first bath 5, in which there are mounted a first and a second anode 8 disposed on one side and the other respectively of the strip 1. The bath 5 contains an electrolytic solution known per se, serving to deposit a first layer of metal, for example copper. Between the strip 1 and the second anode 8 there is located a screen 9 made of a non-conductive material such for example as plastics. This screen 9 serves to mask the anode 8 and thus to prevent deposition of a layer of metal on this side of the strip. In bath 5 only, the anode 6 is supplied with electrical current.

After passing through the first bath 5, the strip to which the first layer has been applied is moved to a second bath 7. In this bath 7, the screen 9 masks the first anode 6 in order to prevent the application of a layer of metal on this side of the strip. The second bath contains a likewise known electrolytic solution which serves, for example, to deposit nickel. In this bath 7, the anode 6 is not supplied with electrical current.

By placing the anodes 6, 8 on one side and the other respectively of the strip, and by using different baths, it is possible to apply a different layer to each side.

According to another embodiment of a device intended for application of two layers of different metal to a strip, each bath 5, 7 contains only a single anode, which avoids the necessity of masking one of the two anodes.

A high current density is preferably used, for example of 250 $A/dm^2$, between the anode and the strip. The high current density has the advantage of being favourable to rapid deposition of metal, and thus avoiding cementation or an electrodeposition effect on the surface opposite to that treated. The shorter the passage time, the less will be the risk of metal reaching the other side of the strip, thus mingling with the layer applied on the other side.

The application of two layers of different metal to a strip may naturally also be brought about by using a device operating at low current density, for example at 10 $A/dm^2$.

I claim:

1. A method of manufacturing a multiple-walled tube, comprising the steps of:

providing a metal strip;

applying a plated layer of a first brazeable metal on one side of the metal strip;

applying a plated layer of a second different brazeable metal to the other side of the metal strip;

rolling the plated metal strip through at least two complete revolutions to form a tube having at least two walls which has one of said plated layers on the inside thereof and the other of said plated layers on the outside thereof; and heating the tube to cause the surfaces of the walls of the tube which are in contact with one another to be brazed, the direction of rolling of said metal strip being dependent upon which of said first and second brazeable layers is to be provided on the inside and outside of said rolled metal tube, whereby two different multiple-walled tubes may be provided from a common plated metal strip.

2. Manufacturing method according to claim 1, in which copper and nickel are applied as the first and second brazeable metals, respectively.

3. Manufacturing method according to claim 1, in which nickel and tin are applied as the first and second brazeable metals, respectively.

4. Manufacturing method according to claim 1, in which tin and copper are applied as the first and second brazeable metals, respectively.

5. Manufacturing method according to claim 1, in which after heating of the strip, a third layer is applied, formed by an alloy, to the external surface of the tube.

6. Manufacturing method according to claim 5, in which a cupro-nickel alloy is applied as the third layer.

7. Manufacturing method according to claim 5, in which a zinc-nickel alloy is applied as the third layer.

8. Manufacturing method according to claim 1, in which the layers are applied using a high current density, electro-plating process.

* * * * *